US008975502B1

(12) United States Patent
Delgado

(10) Patent No.: US 8,975,502 B1
(45) Date of Patent: Mar. 10, 2015

(54) GUITAR WITH BODY-MOUNTED TUNING SYSTEM

(71) Applicant: Rodulfo Delgado, Sunrise, FL (US)

(72) Inventor: Rodulfo Delgado, Sunrise, FL (US)

( * ) Notice: Subject to any disclaimer, the term of this patent is extended or adjusted under 35 U.S.C. 154(b) by 80 days.

(21) Appl. No.: 13/895,085

(22) Filed: May 15, 2013

Related U.S. Application Data

(60) Provisional application No. 61/647,242, filed on May 15, 2012.

(51) Int. Cl.

| | |
|---|---|
| ***G10D 3/00*** | (2006.01) |
| ***G10D 1/08*** | (2006.01) |
| ***G10D 1/00*** | (2006.01) |
| ***G10G 5/00*** | (2006.01) |
| ***G10H 1/32*** | (2006.01) |
| ***G10H 3/18*** | (2006.01) |
| ***G10H 3/00*** | (2006.01) |

(52) U.S. Cl.

CPC ..... *G10H 3/185* (2013.01); *G10H 3/18* (2013.01); *G10H 1/32* (2013.01); *G10G 5/00* (2013.01); *G10D 1/085* (2013.01); *G10H 3/181* (2013.01); *G10D 1/08* (2013.01); *G10D 1/00* (2013.01)

USPC ..... 84/723; 84/290; 84/291; 84/327; 84/726; 84/743

(58) Field of Classification Search

CPC ..... G10D 1/085; G10D 1/00; G10D 1/08; G10G 5/00; G10H 1/32; G10H 3/18; G10H 3/181

USPC ..... 84/723, 290, 291, 327, 726, 743

See application file for complete search history.

(56) References Cited

U.S. PATENT DOCUMENTS

| | | | | |
|---|---|---|---|---|
| 4,334,452 | A * | 6/1982 | Morrison et al. | 84/723 |
| 4,433,603 | A * | 2/1984 | Siminoff | 84/726 |
| 4,915,003 | A * | 4/1990 | Clough | 84/291 |
| 5,197,701 | A * | 3/1993 | Olson | 248/166 |
| 5,637,823 | A * | 6/1997 | Dodge | 84/743 |
| 5,767,432 | A * | 6/1998 | Randolph | 84/743 |
| 5,929,362 | A * | 7/1999 | Oteyza | 84/743 |
| 5,994,633 | A * | 11/1999 | Norton | 84/290 |
| 6,111,184 | A * | 8/2000 | Cloud et al. | 84/723 |
| 6,253,654 | B1 * | 7/2001 | Mercurio | 84/267 |
| 6,603,067 | B1 * | 8/2003 | Woollen | 84/327 |
| 7,208,666 | B2 * | 4/2007 | Burch et al. | 84/327 |
| 7,256,343 | B2 * | 8/2007 | Brubaker et al. | 84/743 |
| 7,442,865 | B2 * | 10/2008 | Moghaddam | 84/290 |
| 8,362,345 | B1 * | 1/2013 | Rice | 84/327 |
| 8,440,894 | B2 * | 5/2013 | Amland | 84/327 |
| 8,455,750 | B1 * | 6/2013 | Severson | 84/743 |
| 8,637,752 | B2 * | 1/2014 | Innocenti | 84/280 |
| 2001/0022129 | A1 * | 9/2001 | Damm | 84/291 |
| 2002/0104424 | A1 * | 8/2002 | Spalt | 84/291 |
| 2003/0164080 | A1 * | 9/2003 | Childress | 84/291 |
| 2005/0132866 | A1 * | 6/2005 | Sawhney et al. | 84/291 |

(Continued)

*Primary Examiner* — David Warren
*Assistant Examiner* — Christina Russell
(74) *Attorney, Agent, or Firm* — Nancy J. Flint, Esq.; Nancy J. Flint, Attorney At Law, P.A.

(57) ABSTRACT

A very efficient guitar design, light weight and having a body-mounted tuning system to assist with performance is disclosed. The guitar comprises two main components: an acoustic body and a housing. This separation is intended so that the acoustic body is isolated from the housing and free to vibrate. The guitar further optionally comprises seven strings, twelve-strings, a vibrato system and a retractable built-in stand attached to the back of the housing.

14 Claims, 8 Drawing Sheets

(56) References Cited

U.S. PATENT DOCUMENTS

| | | | | |
|---|---|---|---|---|
| 2006/0032365 | A1* | 2/2006 | Brubaker et al. | 84/743 |
| 2006/0054009 | A1* | 3/2006 | Redard | 84/723 |
| 2008/0105101 | A1* | 5/2008 | Eldring | 84/291 |
| 2008/0141841 | A1* | 6/2008 | Van Ekstrom | 84/291 |
| 2009/0183626 | A1* | 7/2009 | Salehi | 84/726 |
| 2010/0031800 | A1* | 2/2010 | Ekstrom | 84/291 |
| 2011/0113946 | A1* | 5/2011 | Van Ekstrom | 84/291 |

* cited by examiner

GUITAR WITH BODY-MOUNTED TUNING SYSTEM

RELATED APPLICATION

This application claims the benefit of U.S. Provisional Patent Application No. 61/647,242, titled GUITAR WITH BODY-MOUNTED TUNING SYSTEM and filed on May 15, 2013, the contents of which are herein incorporated in their entirety be reference.

FIELD OF THE INVENTION

The invention is directed to a very efficient guitar design, light weight and having a body-mounted tuning system to assist with performance. The guitar comprises two main components: an acoustic body and a housing. This separation is intended so that the acoustic body is isolated from the housing and free to vibrate. The guitar of the invention further optionally comprises seven strings, twelve-strings, a vibrato system and a retractable built-in stand attached to the back of the housing.

BACKGROUND OF THE INVENTION

The guitar is a plucked string instrument and is made of a body with a rigid neck to which strings, generally six in number, are attached. Strings are numbered 1 to 6, with string 1 closest to the ground as the guitar is held for playing. Guitars are traditionally constructed of various woods, and the strings can be made of animal gut, Nylon or steel. Some modern guitars are made of polycarbonate materials. There are two primary families of guitars: acoustic and electric.

There are three main types of modern acoustic guitars: Classical Nylon-string guitar, steel-string acoustic guitar, and the archtop guitar. The tone of an acoustic guitar is produced by the vibration of the strings, which is amplified by the body of the guitar, which acts as a resonating chamber.

Modern electric guitars have solid bodies and use an amplifier that can electronically manipulate sound. The electronics of an electric guitar are housed in the body of the guitar which can affect tone of the guitar.

A conventional guitar (whether electric or acoustic) is constructed with the following parts:

Headstock—The headstock is located at the end of the guitar neck furthest from the body. The headstock controls the pitch of the strings by means of tuning machines, one per string.

Tuning machines—The tuning machines, made with rotatable buttons tune individual strings to the correct pitch by turning associated capstans clockwise or counter clockwise, which in turn increases or decreases the tension on the string, thereby raising or lowering the string's pitch.

Nut—The nut is a small strip of material located at the joint where the headstock meets the fretboard. The nut has grooves through which each string passes that maintains the spacing between each string along with each string's linear position.

Fretboard—The fretboard runs the length of the neck of the guitar and contains the "frets," which are metal bars that are perpendicular to the neck. The fretboard is the site where the fingers create various notes to be played by depressing the strings. It is made to be replaced as it wears out due to finger action.

Neck—The neck is a long wooden extension to which the guitar's frets, fretboard, tuners and headstock all attach.

Sound Hole—The sound hole (usually round or "F" shape) is the opening in the body of the guitar from which sound resonates. Typically, only classical and acoustic guitars have sound holes.

Pickups—Unlike acoustic guitars, electric guitars have a solid body so a sound hole is not possible. Electric guitars use transducers called "pickups" to change the vibration of the strings into electrical energy by means of magnetic flux modulation. The output of the pickup is sent to an amplifier. The volume of the guitar can then be controlled either by a volume control knob mounted to the body of the guitar or at the amplifier itself.

Bridge—The bridge is mounted to the base of the body of the guitar where the strings originate from and supports the strings.

Guitar Body—The body is the main section of the guitar and contains the sound hole or pickups, the bridge, and other elements such as volume and tone controls. The body can take on many different shapes and sizes and be made of different materials other than wood. Because of this, the body has a great impact on the sound quality of the guitar.

"Headless" guitars having body-mounted tuning (BMT) systems have been known in the art. These guitars unconventionally mount the system for tuning the strings on the body of the guitar, at the opposite end of the strings. With respect to electric guitars, in 1942, Dodo & Osmar of Brazil created a BMT electric guitar, called the "Pau-Elétrico" (electric stick) (Guitarra Baiana). In 1980, Ned Steinberger introduced the L2 bass guitar, based on body-mounted tuning Other guitars having body-mounted tuning designs include the Hohner G3T; Strobel Guitars; Aria Sinsonido; Toone & Townsend; Enorez Voyager; Lawry Modaire; Erlewine Lazer guitar; Traveler Pro and Speedster; DragonFly Electric SoloEtte; LapStick Travel; J-Walker Streaker; Miranda S-250 Travel Guitar and others. Finally, convention calls for a guitar that has a headstock as these types of guitars vastly dominate in the world of music.

SUMMARY OF THE INVENTION

The invention is directed to a very efficient guitar design, light weight and having a body-mounted tuning system to assist with performance. The guitar comprises two main components: an acoustic body and a housing. This separation is intended so that the acoustic body is isolated from the housing and free to vibrate. The guitar of the invention further optionally comprises seven strings, twelve-strings, a vibrato system and a retractable built-in stand attached to the back of the housing.

BRIEF DESCRIPTION OF THE DRAWINGS

The invention will be described with reference to the accompanying drawings, in which like elements are referenced with like numerals.

DESCRIPTION OF THE INVENTION

Figure 1A:
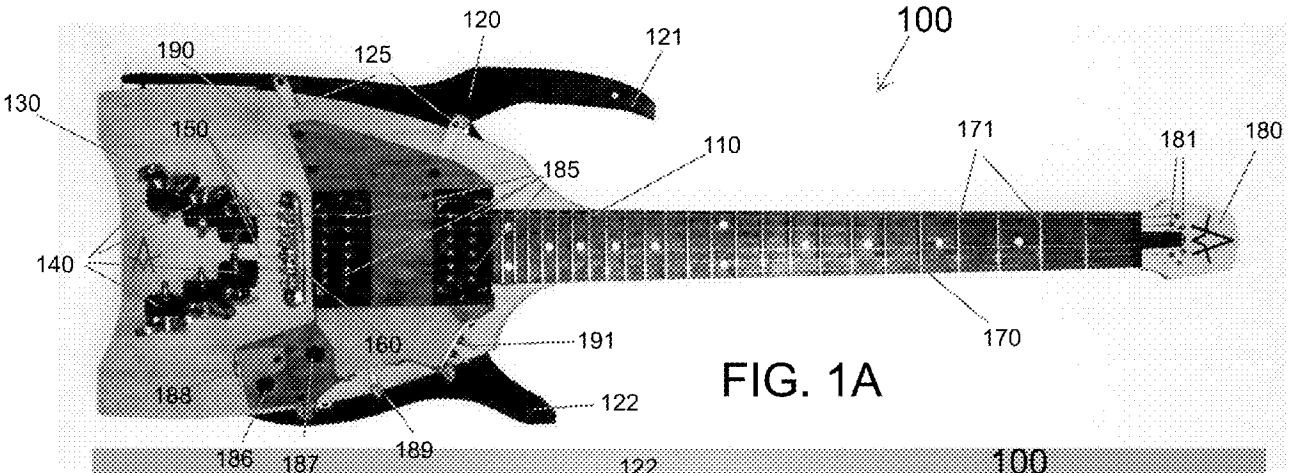
FIG. 1A depicts a front view of the guitar according to one embodiment of the invention.

The invention is directed to a very efficient guitar design, light weight and having a body-mounted tuning system to assist with performance. The guitar comprises two main components: an acoustic body and a housing. This separation is intended so that the acoustic body is isolated from the housing and free to vibrate. The guitar of the invention further optionally comprises seven strings, twelve-strings, a vibrato system and a retractable built-in stand attached to the back of the housing.

In the body-mounted tuning system guitar of the invention, the weight of the headstock is greatly reduced, making the neck lighter and consolidating the center of gravity to improve expression and performance. Tuning with the body-mounted tuning system guitar of the invention allows the performer to hold a chord in position while simultaneously tuning with the "strumming hand." With the guitar, these two functions are more easily achieved during performance. Another benefit of body mounted tuning is that tuning is accomplished with the dominant hand, something that cannot be accomplished with the vast majority of guitars. The use of a body-mounted tuning system shortens the overall length of the guitar by about 4" compared to conventional guitars.

In known body-mounted tuning system guitars, special hardware or special strings have been required, which raises the cost of the materials of the guitar. The body-mounted tuning system guitar of the invention allows for the use of standard hardware as used on conventional guitars, making the guitar affordable and competitive in price with conventional guitars.

Acoustic Body

The acoustic body is a module dedicated to hold the components of the guitar that create acoustic sound. The acoustic body comprises a sound board that is connected to the bottom of the neck, a headstock disposed at the top of the neck, a plurality of strings attached at one end to the headstock and at the other end to individual tuning machines, where the tuning machines are disposed on the sound board, and a bridge disposed on the sound board for supporting the strings. The sound board together with the tuning machines, strings and bridge are also referred to as the acoustic body because these are the components that create the acoustic sound of the guitar.

In one embodiment, the sound board comprises a wood slab that is ¾" thick and contains no cavities, perforations or chambers for the electronics. Approximately 3% of the wood slab is carved out to accommodate the installation of the tuning machines.

Each string is attached on the headstock by way of a hitch and loop. In one embodiment, there are six (6) strings on the guitar. The tuning machines for each of the six strings are placed on the wood body at specific distances and angles to optimize alignment of the strings as well as to provide solid anchoring without bending points for the strings that would cause friction during tuning Each tuning machine comprises a capstan for attaching the string to the tuning machine and a knob (or button) for tuning by tightening or loosening the tension on the attached string.

The guitar uses standard tuning machines (no expensive micrometers) and requires no tools for string installation.

Each tuning machine has its own unique X-Y-Z axis position with respect to the acoustic body and is measured at the point where each string joins the capstan as follows:

The X-axis (the long axis, in line with the neck) defines string leader linearity, which is the linearity of the non-vibrating part, between the capstan and the bridge. This linearity reduces friction during tuning The Y-axis (the short axis, in line with the bridge) defines the distance of each tuning machine to the bridge, and also defines the distance between tuning machines. In one embodiment, the distance between tuning machines is a spacious 1¼ inches.

The Z-axis (perpendicular to the body) defines the string break angle. String break angle is the angle a string makes where it bends over a nut or a bridge. In one embodiment, the string break angle of the guitar of the invention is approximately 15° for the string to press down on the bridge.

Housing

The housing of the guitar provides multiple purposes. The housing holds the pickup module. The pickup module mounts on the housing using brackets that do not interfere with the acoustic body. The housing and pickup module are removable from the guitar by way of removing only a few brackets and without interfering with the acoustic body.

The housing provides the following functions:

a) isolates the acoustic body so the acoustic body is free to vibrate and sustain sound: only four points connect the acoustic body to the housing;

b) provides a protective shield for the back of the acoustic body and holds the pickup module which in turns becomes a shield for the front of the acoustic body;

c) provides support for the performer's forearm, wrist or fingers, depending on preference, so they do not load the acoustic body; also provides a place for any other accessory such as an electronic tuner or a pick holder;

d) provides for holding of the entire guitar 1) while the performer is standing by means of the shoulder strap, 2) while the performer is sitting and nested on the lap 3) while resting on the ground by means of the folding stand and 4) by the built-in handle for transportation; and e) holds together all the components of the guitar as a unit.

The housing can be made of lightweight materials with strong mechanical properties that do not necessarily have to be conducive to sound.

The pickup module: This module contains the pickups, switches and wiring for electronic amplification of sound. It contains three switches that provide the following options:

Switch #1: Phase Shift: this feature reverses the polarity of the neck pickup.

Switch #2: Series/Parallel: the output of the two pickups changes between series and parallel.

Switch #3: Pickup Selector: neck only, neck and bridge, bridge only.

Some of the combinations of these switches require that both pickups be enabled at the same time making only six out of twelve combinations useful.

Other options for the guitar of the invention include the following:

Folding stand—A retractable stand can be integrated into the back of the housing without changing the overall thickness of the housing and with no appreciable change in overall weight of the guitar. The stand could acquire very unique shapes for fashion or advertising. In one embodiment, the stand comprises the "PEACE" symbol. The stand eliminates the need for a separate accessory stand. The stand folds against the housing and latches closed during performances. When deployed, it provides a tripod system using two resting points at the acoustic body of the guitar.

Unibody—The acoustic body and the housing can be integrated into a unitary piece, while the pickup module can be removable.

Fully Acoustic—A fully acoustic guitar option can be accommodated with the use of an acoustic box attached to the back of the acoustic body. The sound board can be thin (approximately ¼") and the pickup module can be replaced by a 'dummy' module to provide support for the 'strumming hand' at both sides of the string group.

Vibrato Arm—The tuning machines can be placed on a platform that can be made movable by isolating it from the acoustic module and mounting it on a flexing system that allows the strings to increase or decrease pitch with the use of a vibrato control arm. This platform becomes a module of its own called a "tuning yoke." Since the strings on a guitar do not stretch at the same rate for the same change in pitch, the guitar of the invention has a system that compensates for different string stretching, based on the fact that a perfectly compensated pitch change is not needed for the vibrato effect to be perceived. The advantage of this vibrato system is that the control arm becomes much more efficient than the conventional control arm.

In one embodiment, the guitar of the invention has the following specifications:

Full size: 24 frets, 25.5"scale, overall Length: 35.5".

Weight: 5.5 lb.

Neck: Maple with rosewood fingerboard and jumbo frets.

Acoustic Body: Poplar ¾".

Housing: Poplar.

Pickup module: Poplar frame with two humbucker pickups using two, dual-position switches (single-pole and double-pole) for serial/parallel, and phase-shift to provide 6 useful sound combinations.

One volume control and one tone control.

Standard tuners, 18:1 turn ratio.

Built-in folding stand.

The guitar of the invention provides a number of other advantages over current conventional guitars and also current body-mounted tuning guitars:

The modular construction allows the use of different materials such as woods with exceptional sound qualities for the acoustic body and modern technology materials or composites applied to the housing for specific purposes, all within the same guitar.

The removable pickup module allows the guitar to be configured to many different favorite styles, using up to three pickups of different types, multiple volume and tone controls and multiple switches. The pickups are easy to be replaced as performers prefer to install pickups of their preference. The pickup module could be configured to use the guitar acoustically with the use of a pickup designed for acoustic guitars or an acoustic box attachment.

Turning to the figures, FIG. 1A depicts a front view of the guitar 100 according to one embodiment of the invention. Guitar 100 comprises an acoustic body 110 and a housing 120. Acoustic body 100 comprises a sound board 130, a plurality of tuning machines 140, a plurality of strings 150 and a bridge 160. Acoustic body 110 further comprises a neck 170 and a headstock 180. Neck 170 comprises a plurality of frets 171. Each string 150 is attached to headstock 180 by a hitch and loop 181. Housing 120 comprises a pickup module 190 and a handle 121 and rear support 122. Pickup module 190 comprises a plurality of pickups 185, a tone control 186, a volume control 187, a sound output jack 188, a pickup selector 189 and phase shift and parallel/serial switches 191. Pickup module 190 is connected to housing 120 by way of a plurality of brackets 125 that do not interfere with the acoustic body.

Figure 1B:
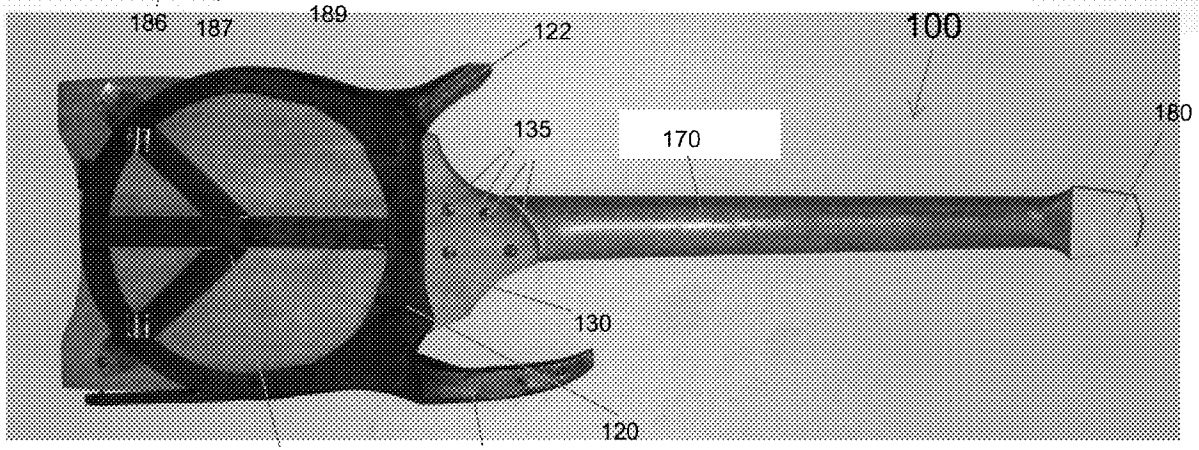
FIG. 1B depicts a back view of the guitar according to one embodiment of the invention.

FIG. 1B depicts a back view of guitar 100 according to one embodiment of the invention. Housing 120 of guitar 100 further comprises a folding stand 195. Sound board 130 is attached to neck 170 by way of a plurality of screws 135 in this embodiment.

Figure 1C:
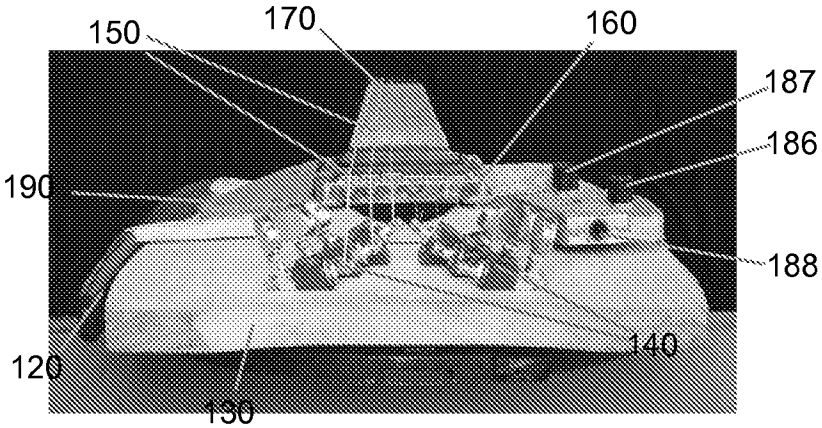
FIG. 1C depicts a bottom view of the guitar according to one embodiment of the invention.

FIG. 1C depicts a bottom view of guitar 100 according to one embodiment of the invention showing housing 120, sound board 130, tuning machines 140, strings 150, bridge 160, neck 170, pickup module 190, tone control 186, volume control 187 and sound output jack 188.

Figure 2A:
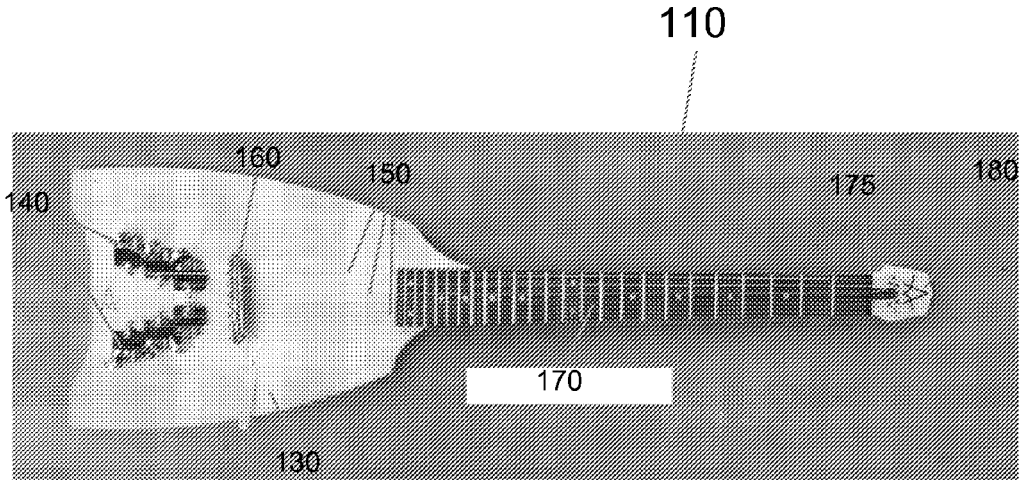
FIG. 2A depicts a front view of the acoustic body of the guitar according to one embodiment of the invention.

FIG. 2A depicts a front view of acoustic body 110 of guitar 100 according to one embodiment of the invention. Acoustic body 100 comprises sound board 130, tuning machines 140, strings 150, bridge 160, neck 170 and headstock 180. Headstock 180 is an extension of neck 170 in this embodiment of the invention. A nut 175 is disposed on neck 170 to provide separation between strings 150 and frets 171.

Figure 2B:
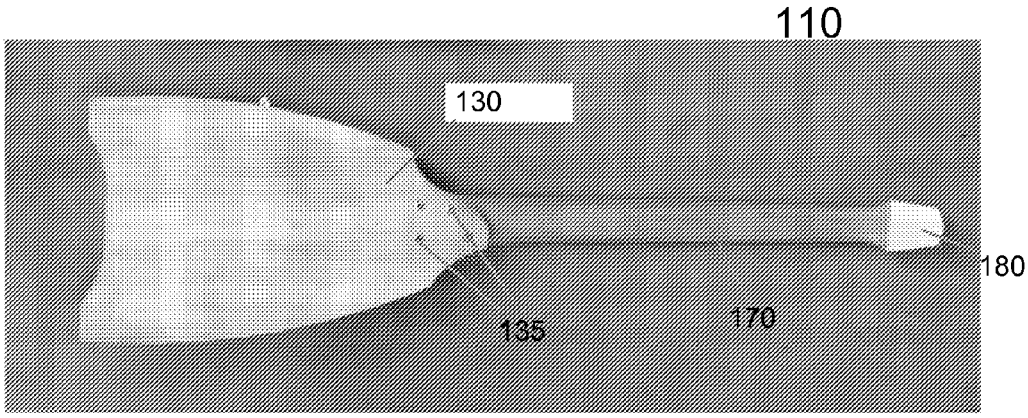
FIG. 2B depicts a back view of the acoustic body of the guitar according to one embodiment of the invention.

FIG. 2B depicts a back view of acoustic body 110 of the guitar 100 according to one embodiment of the invention showing sound board 130, screws 135, neck 170 and headstock 180.

Figure 3A:
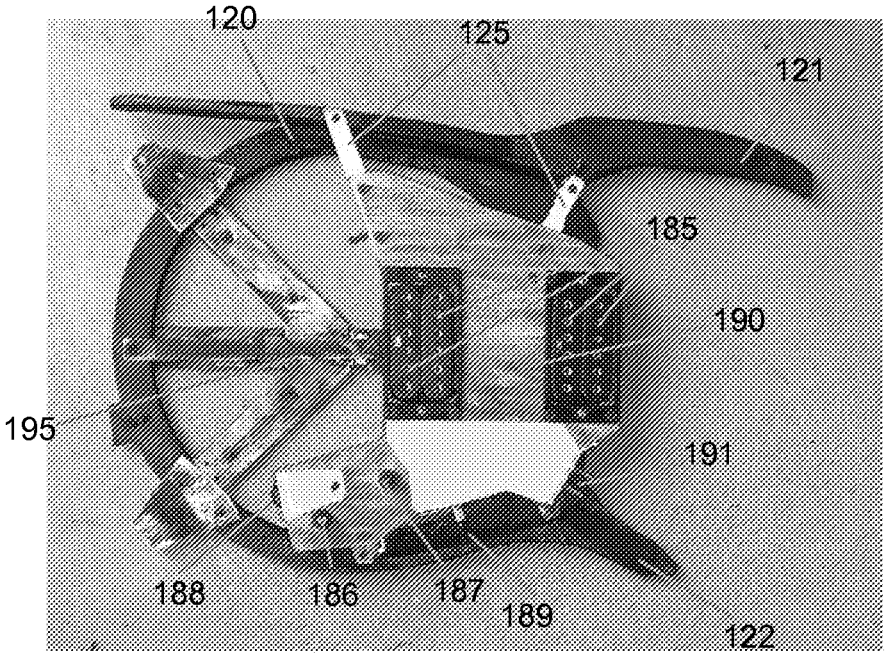
FIG. 3A depicts a front view of the housing of the guitar according to one embodiment of the invention.

FIG. 3A depicts a front view of housing 120 of guitar 110 according to one embodiment of the invention. Housing 120 comprises handle 121, rear support 122, pickup module 190 comprising a pickups 185, tone control 186, volume control 187, sound output jack 188, pickup selector 189, phase shift and parallel/serial switches 191 and optionally folding stand 195. Pickup module 190 is connected to housing 120 by way of brackets 125.

Figure 3B:
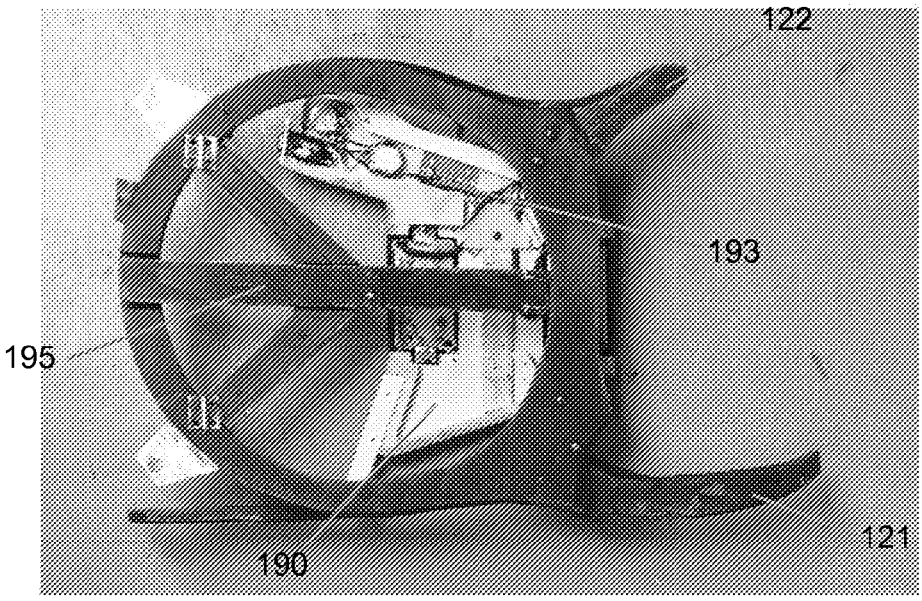
FIG. 3B depicts a back view of the housing of the guitar according to one embodiment of the invention.

FIG. 3B depicts a back view of housing 120 of guitar 110 according to one embodiment of the invention showing handle 121, rear support 122, folding stand 195 and switching and wiring 193 on rear of pickup module 190.

Figure 4B:
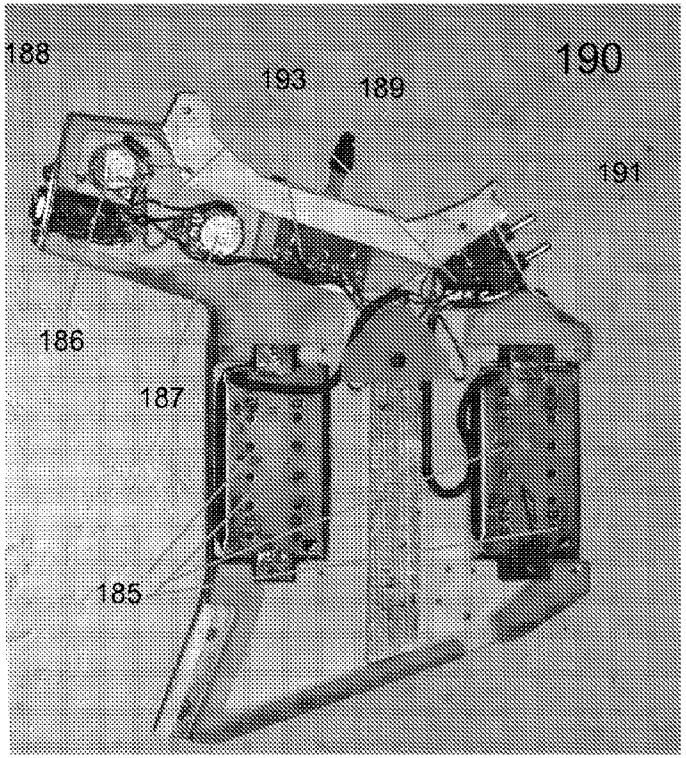
FIG. 4B depicts a back view of the pickup module of the guitar according to one embodiment of the invention.
Figure 4A:
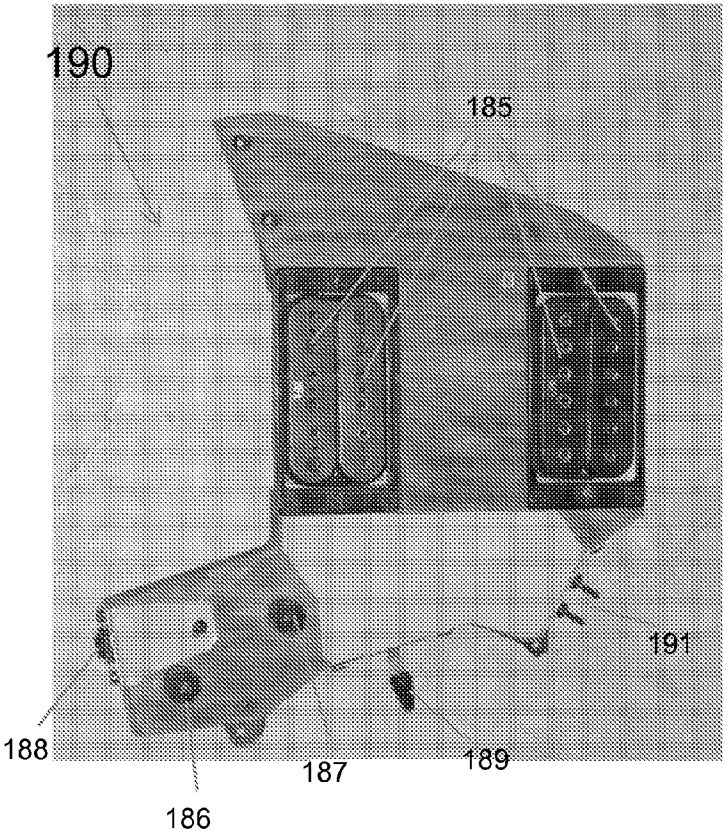
FIG. 4A depicts a front view of the pickup module of the guitar according to one embodiment of the invention.

FIG. 4A depicts a front view of pickup module 190 of guitar 100 according to one embodiment of the invention. Pickup module 190 comprises pickups 185, tone control 186, volume control 187, sound output jack 188, pickup selector 189, phase shift and parallel/serial switches 191.

FIG. 4B depicts a back view of pickup module 190 of guitar 100 according to one embodiment of the invention showing pickup selector 189 and phase shift and parallel/serial switches 191, as well as switches and wiring 193 for pickup module 190.

Figure 5:
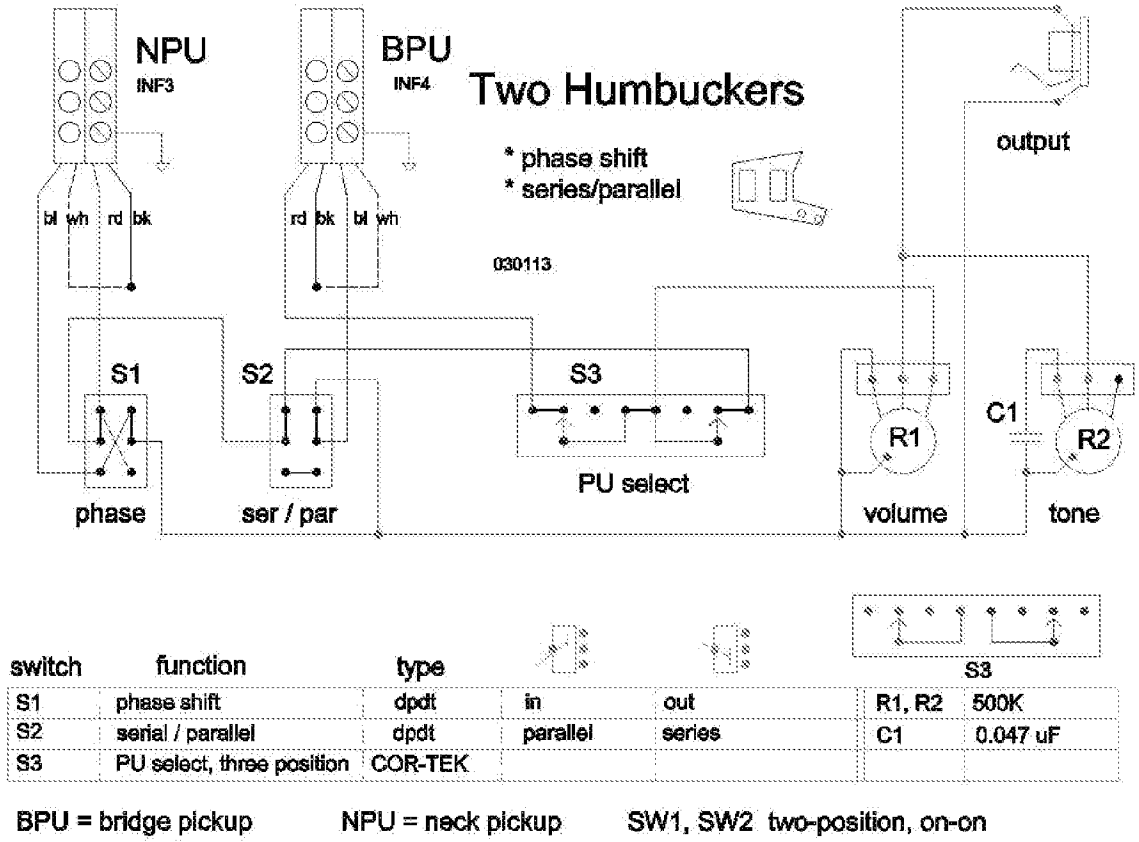
FIG. 5 depicts a schematic diagram of the wiring system of the guitar according to one embodiment of the invention.

FIG. 5 depicts a schematic diagram of the wiring system of phase shift and parallel/serial switches 191 of guitar 100 according to one embodiment of the invention.

Figure 6:
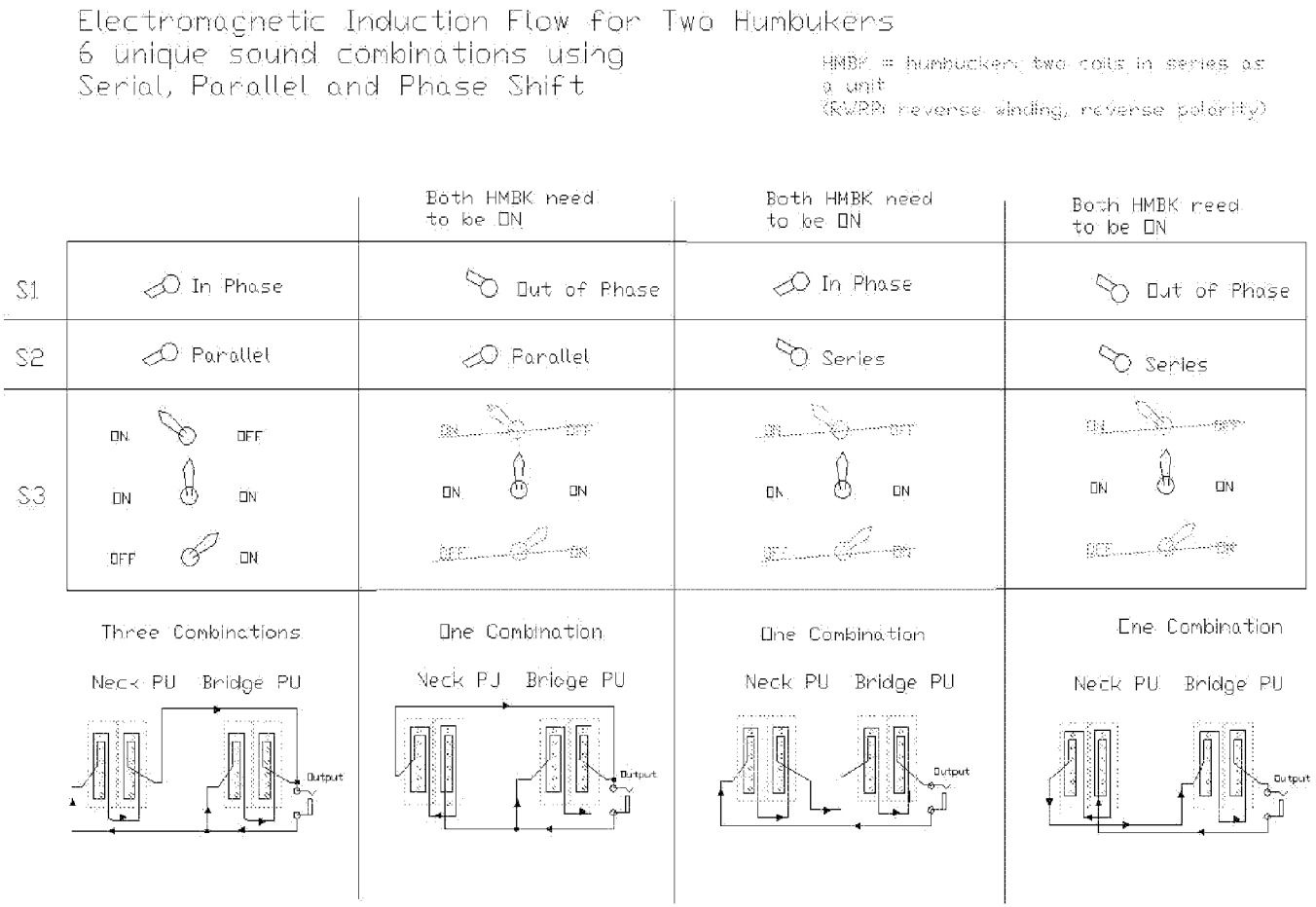
FIG. 6 depicts the sound combinations and electromagnetic flow through the pickup modules of the guitar according to one embodiment of the invention.

FIG. 6 depicts the sound combinations and electromagnetic flow through pickups 185 due to positions of phase shift and parallel/serial switches 191 of guitar 100 according to one embodiment of the invention.

Figure 7D:
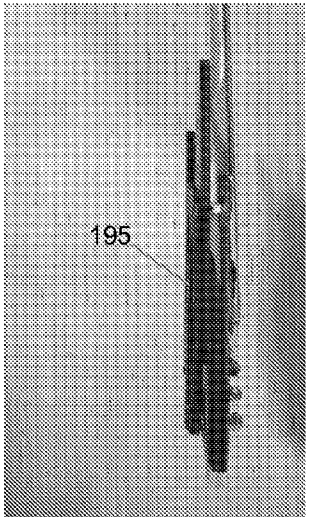
FIG. 7D depicts a side view of the guitar according to one embodiment of the invention showing the folding stand in the closed position.
Figure 7C:
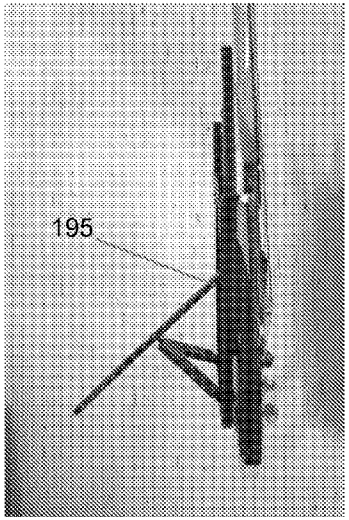
FIG. 7C depicts a side view of the guitar according to one embodiment of the invention showing the folding stand in the extended position.
Figure 7B:
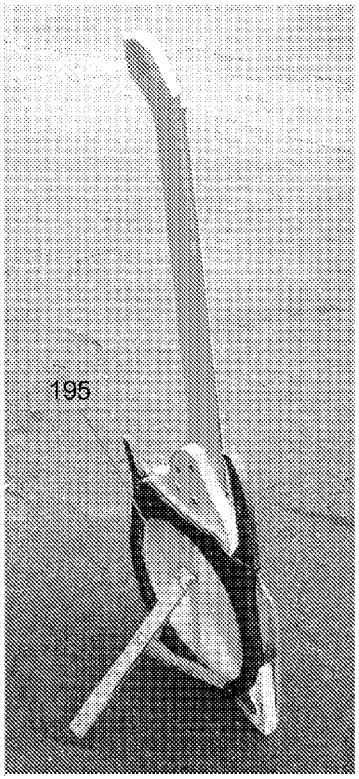
FIG. 7B depicts a back perspective view of the guitar according to one embodiment of the invention showing the folding stand in the extended position.
Figure 7A:
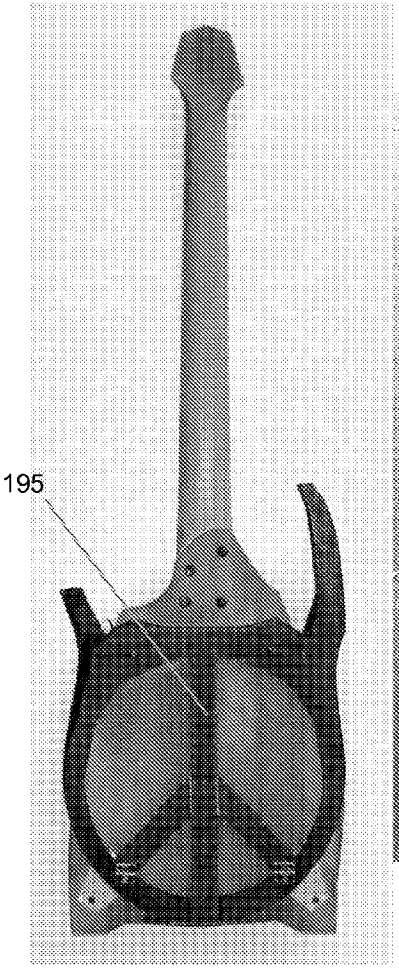
FIG. 7A depicts a back view of the guitar according to one embodiment of the invention showing the folding stand in the closed position.

FIG. 7A depicts a back view of guitar 100 according to one embodiment of the invention showing folding stand 195 in the closed position.

FIG. 7B depicts a back perspective view of guitar 100 according to one embodiment of the invention showing folding stand 195 in the extended position.

FIG. 7C depicts a side view of guitar 100 according to one embodiment of the invention showing folding stand 195 in the extended position.

FIG. 7D depicts a side view of guitar 100 according to one embodiment of the invention showing folding stand 195 in the closed position.

In the foregoing description, the present invention has been described with reference to specific exemplary embodiments thereof. It will be apparent to those skilled in the art that a person understanding this invention may conceive of changes or other embodiments or variations, which utilize the principles of this invention without departing from the broader spirit and scope of the invention. The specification and drawings are, therefore, to be regarded in an illustrative rather than a restrictive sense. Accordingly, it is not intended that the invention be limited except as may be necessary in view of the appended claims.

What is claimed is:

1. A guitar comprising:

an acoustic body; and a housing, wherein the acoustic body comprises a sound board, a plurality of tuning machines disposed on the sound board, a plurality of strings each attached to a tuning machine and a bridge disposed on the sound board, wherein the acoustic body further comprises a neck and a headstock, wherein the housing comprises a pickup module, a handle and a rear support, wherein the pickup module comprises a plurality of pickups, a sound output jack, a pickup selector and a plurality of phase shift and parallel/serial switches, wherein the pickup module is removably connected to the housing by way of a plurality of brackets that do not interfere with the acoustic body.

2. The guitar of claim 1, wherein the neck comprises a plurality of frets.

3. The guitar of claim 2, wherein each string is attached to the headstock by a hitch and loop.

4. The guitar of claim 1, wherein each tuning machine comprises a capstan for attaching a string to the tuning machine and a knob for tuning by changing the tension on the attached string.

5. The guitar of claim 4, wherein the placement of each of the tuning machines on the sound board is at a specific distance and angle to optimize alignment of the attached string.

6. The guitar of claim 5, wherein the placement of each of the tuning machines on the sound board provides solid anchoring without bending points for the attached string.

7. The guitar of claim 1, wherein the pickup module further comprises a tone control and a volume control.

8. The guitar of claim 7, wherein the pickup module comprises two humbucker pickups using two, dual-position switches for serial/parallel, and phase-shift.

9. The guitar of claim 1, comprising six (6) strings.

10. The guitar of claim 1, comprising twelve (12) strings.

11. The guitar of claim 1, wherein the acoustic body is isolated from the housing and does not interfere with the vibration of the housing.

12. The guitar of claim 1, further comprising a retractable built-in stand attached to the back of the housing.

13. The guitar of claim 1, wherein the pickups are configured for an acoustic guitar.

14. The guitar of claim 1, wherein the sound board comprises poplar.

* * * * *